US012091846B2

(12) United States Patent
Xie et al.

(10) Patent No.: US 12,091,846 B2
(45) Date of Patent: Sep. 17, 2024

(54) SHOWER HEAD HOLDER AND EASY-TO-USE COMBINED SHOWER SET

(71) Applicant: Protech (Xiamen) Industry Co., Ltd., Fujian (CN)

(72) Inventors: Pengwei Xie, Xiamen (CN); Zehe Xie, Xiamen (CN)

( * ) Notice: Subject to any disclaimer, the term of this patent is extended or adjusted under 35 U.S.C. 154(b) by 0 days.

(21) Appl. No.: 18/116,833

(22) Filed: Mar. 2, 2023

(65) Prior Publication Data

US 2024/0159034 A1 May 16, 2024

(30) Foreign Application Priority Data

Nov. 14, 2022 (CN) ..... 202223032851.3

(51) Int. Cl.
*E03C 1/06* (2006.01)

(52) U.S. Cl.
CPC ..... *E03C 1/066* (2013.01)

(58) Field of Classification Search
CPC ..... E03C 1/066; E03C 1/06
See application file for complete search history.

(56) References Cited

U.S. PATENT DOCUMENTS 3,806,963 A * 4/1974 Flynn ..... E03C 1/06 4/615
5,749,552 A * 5/1998 Fan ..... E03C 1/066 248/205.8
5,833,192 A * 11/1998 Buhrman ..... E03C 1/06 248/295.11
7,748,649 B2 * 7/2010 Fujii ..... E03C 1/066 239/548
7,857,241 B2 * 12/2010 Deng ..... E03C 1/0408 239/443
D639,391 S * 6/2011 Yongyan ..... D23/228
8,082,610 B2 * 12/2011 Henry ..... E03C 1/023 4/615
8,191,185 B2 * 6/2012 Tsai ..... E03C 1/06 4/615
8,683,624 B1 * 4/2014 Zhadanov ..... E03C 1/025 4/615
9,149,826 B2 * 10/2015 Vartanian ..... B05B 15/65
9,410,309 B2 * 8/2016 Sharratt ..... E03C 1/066
10,081,025 B2 * 9/2018 Lin ..... B05B 1/185
10,245,610 B2 * 4/2019 Johnson ..... B05B 1/18
10,322,058 B1 * 6/2019 Patch ..... A61H 19/30
10,352,025 B2 * 7/2019 Culmer ..... F16K 31/602
D963,111 S * 9/2022 He ..... D23/223
11,808,361 B2 * 11/2023 Yang ..... E03C 1/023
11,927,000 B2 * 3/2024 Wang ..... E03C 1/06
2005/0193487 A1 * 9/2005 Watari ..... E03C 1/066 4/570

(Continued)

*Primary Examiner* — Eret C McNichols

(57) ABSTRACT

A shower head holder and an easy-to-use combined shower set are disclosed. The shower head holder includes a connector and a holder body connected to the connector. The holder body is equipped with a shower head seat that is lower than the connector. When the connector of the shower head holder is connected to a three-way switching valve and an overhead shower head, the shower head seat is low in height, so that it is convenient for a short user to place a hand-held shower head on the shower head seat or remove the hand-held shower head from the shower head seat.

9 Claims, 13 Drawing Sheets

(56) References Cited

U.S. PATENT DOCUMENTS

| | | | | |
|---|---|---|---|---|
| 2008/0169362 | A1* | 7/2008 | Kwan | E03C 1/066 239/442 |
| 2010/0024909 | A1* | 2/2010 | Lu | E03C 1/06 137/861 |
| 2015/0033470 | A1* | 2/2015 | Sharratt | E03C 1/0408 4/695 |
| 2017/0314240 | A1* | 11/2017 | Culmer | B05B 1/1636 |
| 2021/0079632 | A1* | 3/2021 | Beattie | F16K 11/0445 |
| 2023/0086368 | A1* | 3/2023 | Miller | A47K 3/28 239/280 |
| 2023/0109101 | A1* | 4/2023 | Yang | E03C 1/066 285/33 |
| 2023/0151594 | A1* | 5/2023 | Li | E03C 1/0408 239/283 |
| 2023/0175240 | A1* | 6/2023 | Yan | E03C 1/0408 239/281 |
| 2023/0383509 | A1* | 11/2023 | Wilson | E03C 1/025 |

* cited by examiner

SHOWER HEAD HOLDER AND EASY-TO-USE COMBINED SHOWER SET

BACKGROUND OF THE INVENTION

1. Field of the Invention

The present invention relates to sanitary wares, and more particularly to a shower head holder and an easy-to-use combined shower set.

2. Description of the Prior Art

In some areas such as the United States, it is required to arrange the outlet of the water supply pipe at the upper part of the wall. An overhead shower head is directly connected to the water supply pipe. The user uses the overhead shower head for taking a shower, which cannot meet the needs of users who want to use a hand-held shower head.

A combined shower set is developed to solve the above-mentioned problem. The combined shower set includes a three-way switching valve, an overhead shower head and a hand-held shower head. The inlet of the three-way switching valve is connected to the water supply pipe. One outlet of the three-way switching valve is connected to the overhead shower head, and the other outlet of the three-way switching valve is connected to the hand-held shower head via a hose. The three-way switching valve is equipped with a shower head seat for holding the hand-held shower head. There is a problem in the existing combined shower set, that is, after the inlet of the three-way switching valve of the combined shower set is connected to the water supply pipe mounted to the wall, the three-way switching valve is located on the upper part of the wall so the shower head seat of the three-way switching valve is located at a higher position. It is inconvenient for short users (such as children) to place the hand-held shower head on the shower head seat of the three-way switching valve or remove the hand-held shower head on the shower head seat of the three-way switching valve.

SUMMARY OF THE INVENTION

The primary object of the present invention is to provide a shower head holder and an easy-to-use combined shower set. The shower head holder can facilitate short users to place or remove a hand-held shower head.

In order to achieve the above object, the present invention adopts the following technical solutions:

A shower head holder comprises a connector and a holder body connected to the connector. The connector has a water inlet and a water outlet communicating with the water inlet. The holder body is equipped with a shower head seat for holding a hand-held shower head. The shower head seat is lower than the connector.

The holder body includes a retaining seat connected to the connector and a movable frame hinged to the retaining seat. The movable frame is equipped with the shower head seat.

The retaining seat has a receiving hole for receiving the connector. An elastic ring is disposed between an inner wall of the receiving hole and the connector.

An elastic member is disposed at a hinge joint of the retaining seat and the movable frame. Two sides of the elastic member lean against the retaining seat and the movable frame, respectively.

The elastic member is an elastic gasket or a spring.

The movable frame has a plurality of positioning grooves arranged radially. The retaining seat has positioning ribs that are movably fitted with the positioning grooves.

The retaining seat and the movable frame are hinged through a hinge shaft. The hinge shaft passes through the elastic member.

The movable frame includes a first connecting rod and an opposing second connecting rod. The first connecting rod has a through hole. The second connecting rod has a screw hole. The retaining seat is connected between the first connecting rod and the second connecting rod. The retaining seat has a rotation hole. Two ends of the hinge shaft are defined as an engaging end and a threaded end, respectively. The engaging end of the hinge shaft is in contact with the first connecting rod. The threaded end of the hinge shaft passes through the through hole of the first connecting rod and the rotation hole of the retaining seat in sequence and is screwed to the screw hole of the second connecting rod.

The shower head seat is installed on the holder body and is adjustable in height.

The holder body has a slot extending in a direction along its length. The shower head seat is locked to the holder body by a bolt passing through the slot.

The water inlet of the connector is equipped with a rotatable nut. An outer wall of the water outlet of the connector is formed with an external thread.

An easy-to-use combined shower set comprises a three-way switching valve, an overhead shower head, a hand-held shower head, and the foregoing shower head holder. The three-way switching valve has a first outlet and a second outlet. The hand-held shower head is connected to the first outlet of the three-way switching valve via a hose. The overhead shower head is connected to the second outlet of the three-way switching valve via the shower head holder. The water inlet of the connector of the shower head holder is connected to the second outlet of the three-way switching valve. The water outlet of the connector of the shower head holder is connected to the overhead shower head.

With the above-mentioned technical solutions, the shower head holder of the present invention includes the connector and the holder body. The holder body is equipped with the shower head seat for holding the hand-held shower head. The shower head seat is lower than the connector configured to connect the three-way switching valve and the overhead shower head. In this way, when the shower head holder of the present invention is connected to the three-way switching valve and the overhead shower head, the shower head seat is low in height, so that it is convenient for a short user to place the hand-held shower head on the shower head seat or remove the hand-held shower head from the shower head seat. In addition, the shower head holder of the present invention has the connector for connecting the three-way switching valve and the overhead shower head. In this way, the shower head holder of the present invention can be adapted to the existing combined shower set, so that the user can purchase the shower head holder of the present invention separately and modify the existing combined shower set at home into the easy-to-use combined shower set of the present invention.

DETAILED DESCRIPTION OF THE PREFERRED EMBODIMENTS

Figure 1:
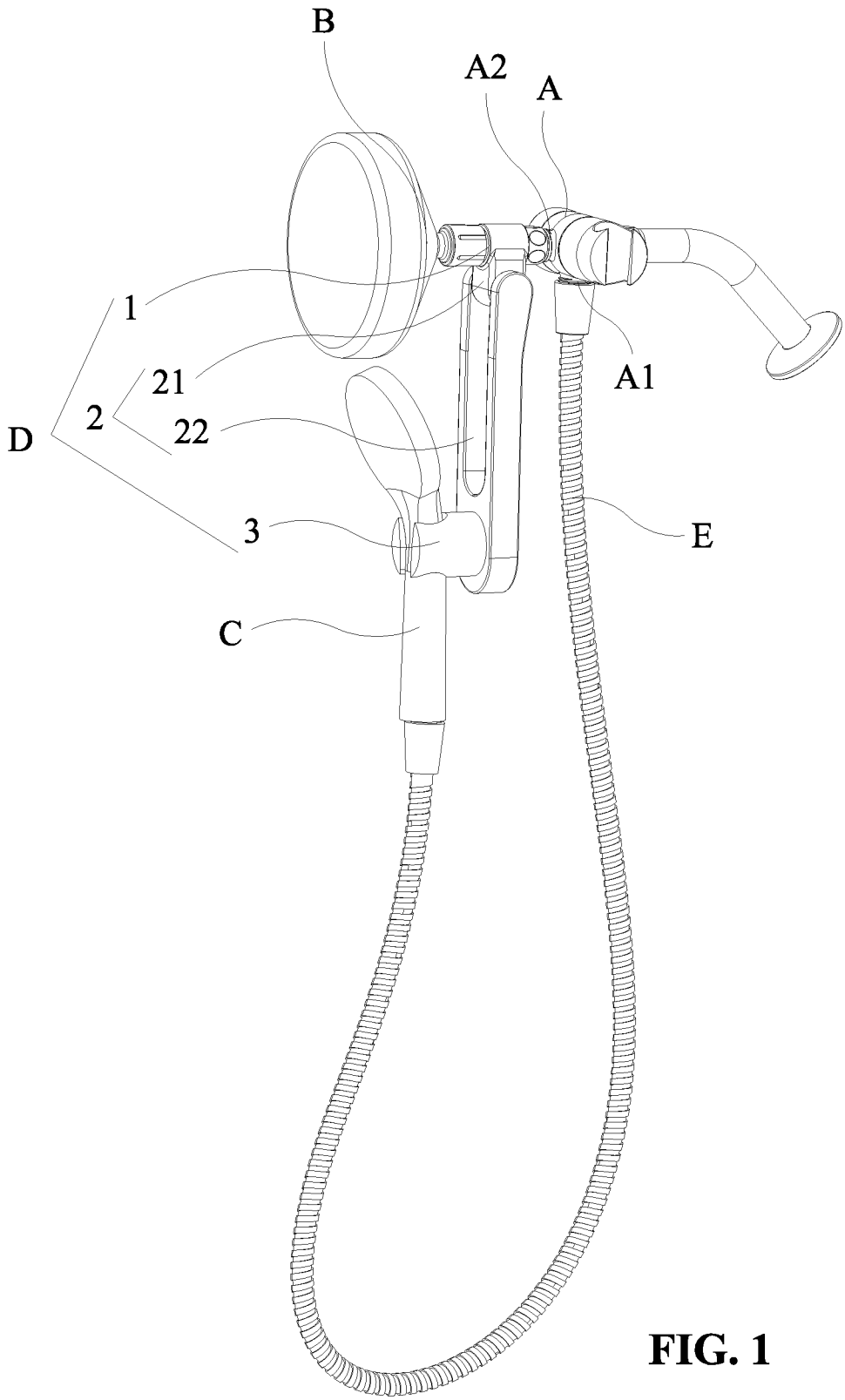
FIG. 1 is a schematic view of the easy-to-use combined shower set according to a first embodiment of the present invention.

Embodiments of the present invention will now be described, by way of example only, with reference to the accompanying drawings.

Referring to FIG. 1 through FIG. 13, the present invention discloses an easy-to-use combined shower set, comprising a three-way switching valve A, an overhead shower head B, a hand-held shower head C, and a shower head holder D. The three-way switching valve A has a first outlet A1 and a second outlet A2. The hand-held shower head C is connected to the first outlet A1 of the three-way switching valve A via a hose E. The overhead shower head B is connected to the second outlet A2 of the three-way switching valve A via the shower head holder D.

Referring to FIG. 1 through FIG. 13, the shower head holder D includes a connector 1 and a holder body 2 connected to the connector 1. The connector 1 has a water inlet 11 and a water outlet 12 communicating with the water inlet 11. The water inlet 11 of the connector 1 is connected to the second outlet A2 of the three-way switching valve A. The water outlet 12 of the connector 1 is connected to the overhead shower head B. The holder body 2 is equipped with a shower head seat 3 for holding the hand-held shower head C. The shower head seat 3 is lower than the connector 1.

As shown in FIG. 2, FIG. 3, FIG. 6 and FIG. 10, the water inlet 11 of the connector 1 may be equipped with a rotatable nut 111 for connecting the second outlet A2 of the three-way switching valve A. The outer wall of the water outlet 12 of the connector 1 is formed with an external thread 121 for connecting the inlet of the overhead shower head A.

Referring to FIG. 1 through FIG. 13, the holder body 2 may include a retaining seat 21 connected to the connector 1 and a movable frame 22 hinged to the retaining seat 21. The movable frame 22 is equipped with the shower head seat 3. This arrangement enables the user to rotate the movable frame 22 for adjusting the position of the shower head seat 3 to be held, so that the angle and height of the hand-held shower head C held on the shower head seat 3 can be adjusted for taking a shower, so as to meet the shower requirements of different users.

As shown in FIG. 3, FIG. 4, FIG. 6 and FIG. 11, the retaining seat 21 has a receiving hole 211 for receiving the connector 1 so that the connector 1 is connected to the retaining seat 21. An elastic ring 4 is disposed between the inner wall of the receiving hole 211 and the connector 1. The elastic ring 4 can improve the rotation damping between the retaining seat 21 and the connector 1, such that the retaining seat 21 and the connector 1 can be connected stably.

As shown in FIG. 2, FIG. 3, FIG. 6, FIG. 7, FIG. 10 and FIG. 11, the retaining seat 21 and the movable frame 22 are hinged through a hinge shaft 23. The movable frame 22 includes a first connecting rod 221 and an opposing second connecting rod 222. The retaining seat 21 is connected between the first connecting rod 221 and the second connecting rod 222. The hinge shaft 23 passes through the first connecting rod 221, the retaining seat 21 and the second connecting rod 222. The retaining seat 21 is rotatably sleeved on the hinge shaft 23. Both ends of the hinge shaft 23 are connected to the first connecting rod 221 and the second connecting rod 222, respectively. Specifically, the first connecting rod 221 has a through hole 2211, the second connecting rod 222 has a screw hole 2221, and the retaining seat 21 has a rotation hole 212. Both ends of the hinge shaft 23 are defined as an engaging end 231 and a threaded end 232, respectively. The engaging end 231 of the hinge shaft 23 is in contact with the first connecting rod 221. The threaded end 232 of the hinge shaft 23 passes through the through hole 2211 of the first connecting rod 221 and the rotation hole 212 of the retaining seat 21 in sequence and is screwed to the screw hole 2221 of the second connecting rod 222.

Figure 3:
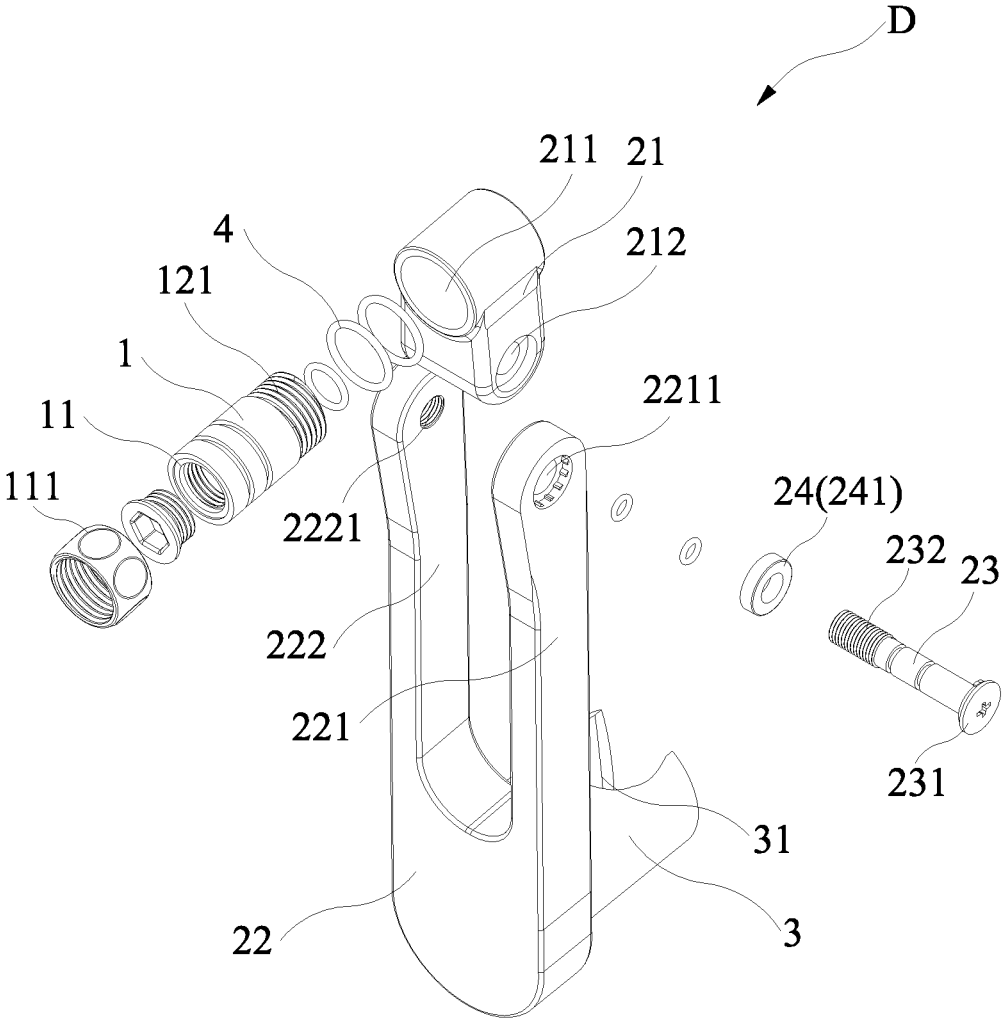
FIG. 3 is an exploded view of the shower head holder according to the first embodiment of the present invention.
Figure 4:
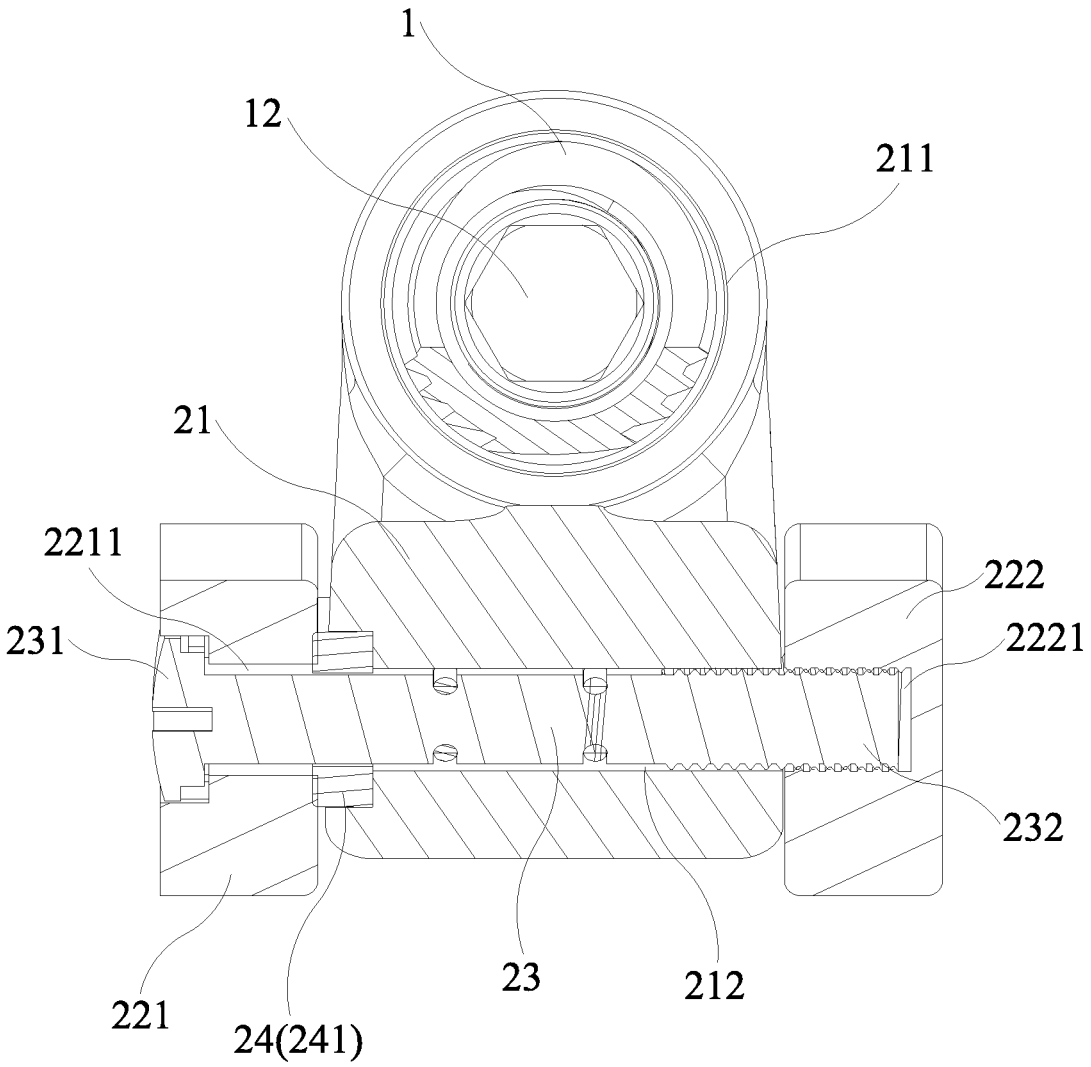
FIG. 4 is a cross-sectional view of the shower head holder according to the first embodiment of the present invention.
Figure 5:
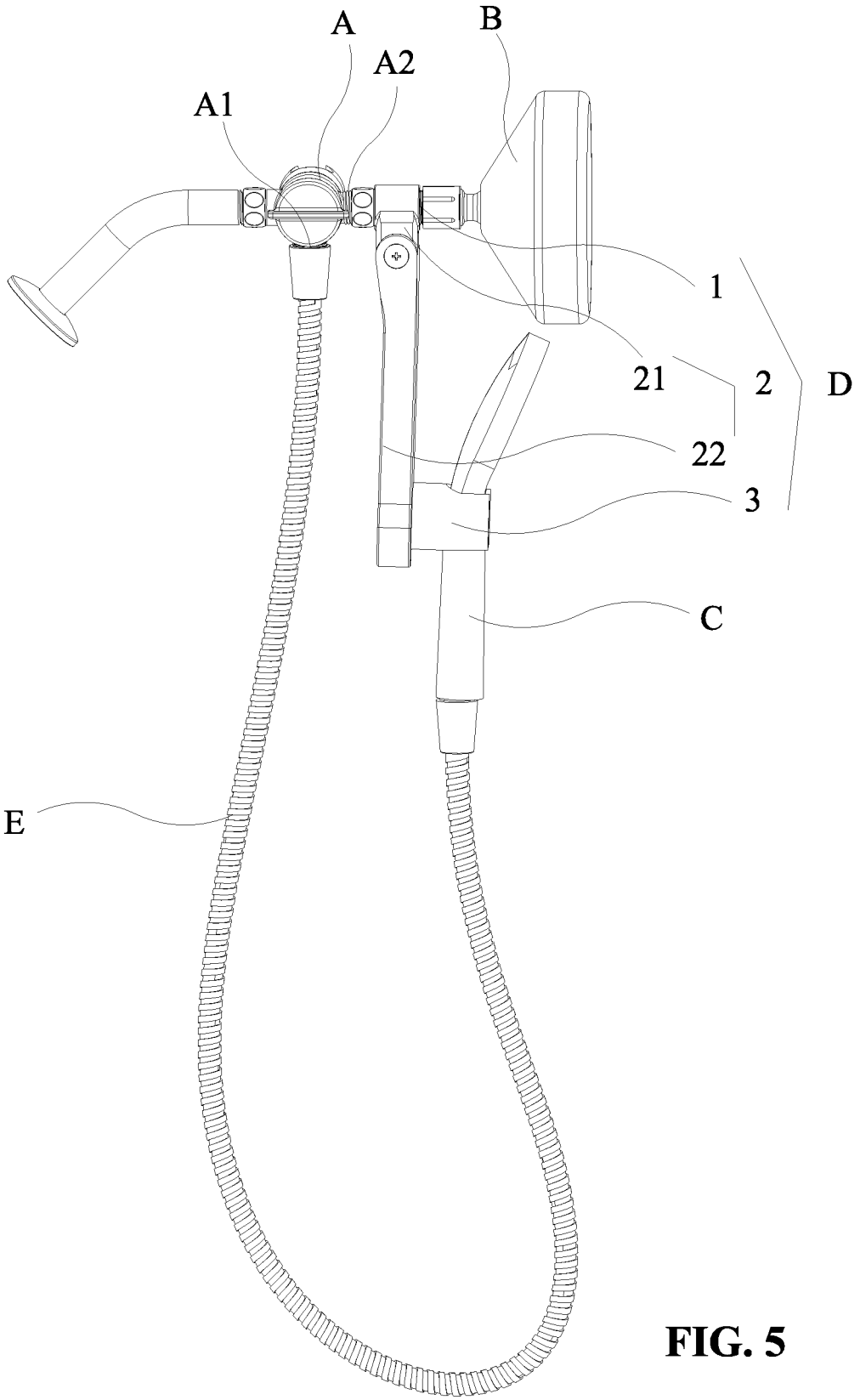
FIG. 5 is a schematic view of the easy-to-use combined shower set according to a second embodiment of the present invention.

As shown in FIG. 3, FIG. 4, FIG. 6, FIG. 7, FIG. 11 and FIG. 12, an elastic member 24 is disposed at the hinge joint of the retaining seat 21 and the movable frame 22. Both sides of the elastic member 24 lean against the retaining seat 21 and the movable frame 22, respectively. The hinge shaft 23 passes through the elastic member 24 to prevent the elastic member 24 from falling. The elastic member 24 is configured to improve the rotation damping between the retaining seat 21 and the movable frame 22, so that the movable frame 22 can be kept in the desired position after the movable frame 22 is rotated relative to the retaining seat 21. Referring to FIG. 3 and FIG. 4, in a first embodiment of the present invention, the elastic member 24 is an elastic gasket 241. The user can adjust the pressure of the retaining seat 21 and the movable frame 22 on the elastic gasket 241 by rotating the hinge shaft 23, so as to ensure sufficient rotation damping between the retaining seat 21 and the movable frame 22 to position the movable frame 22. Referring to FIG. 6, FIG. 8, FIG. 11 and FIG. 12, in second and third embodiments of the present invention, the elastic member 24 is a spring 242. The second connecting rod 222 of the movable frame 22 has a plurality of positioning grooves 2222 arranged radially. The retaining seat 21 has positioning ribs 213 that are movably fitted with the positioning grooves 2222. In the present invention, through the cooperation of the positioning grooves 2222 and the positioning ribs 213, the movable frame 22 can be positioned more stably in one of multiple positions corresponding to the positioning grooves 2222.

Figure 2:
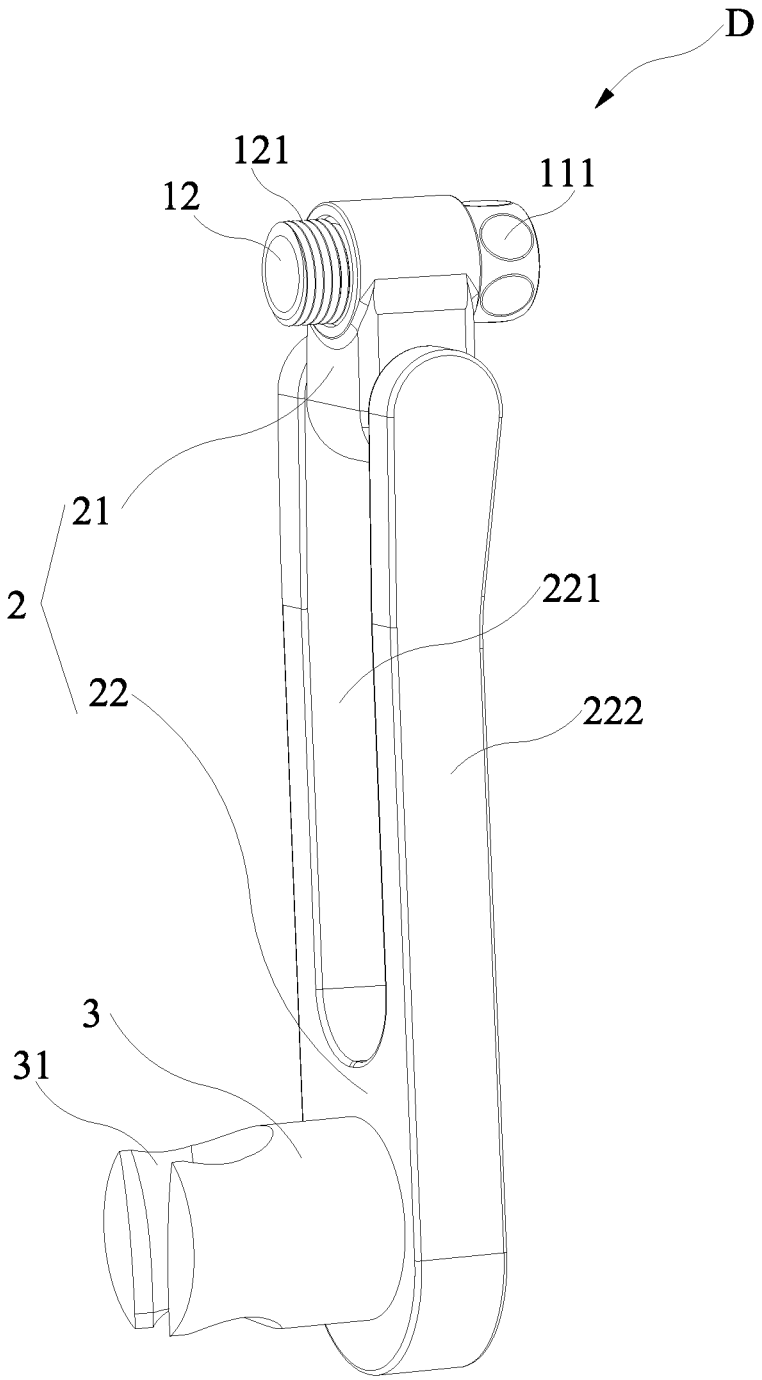
FIG. 2 is a schematic view of the shower head holder according to the first embodiment of the present invention.
Figure 6:
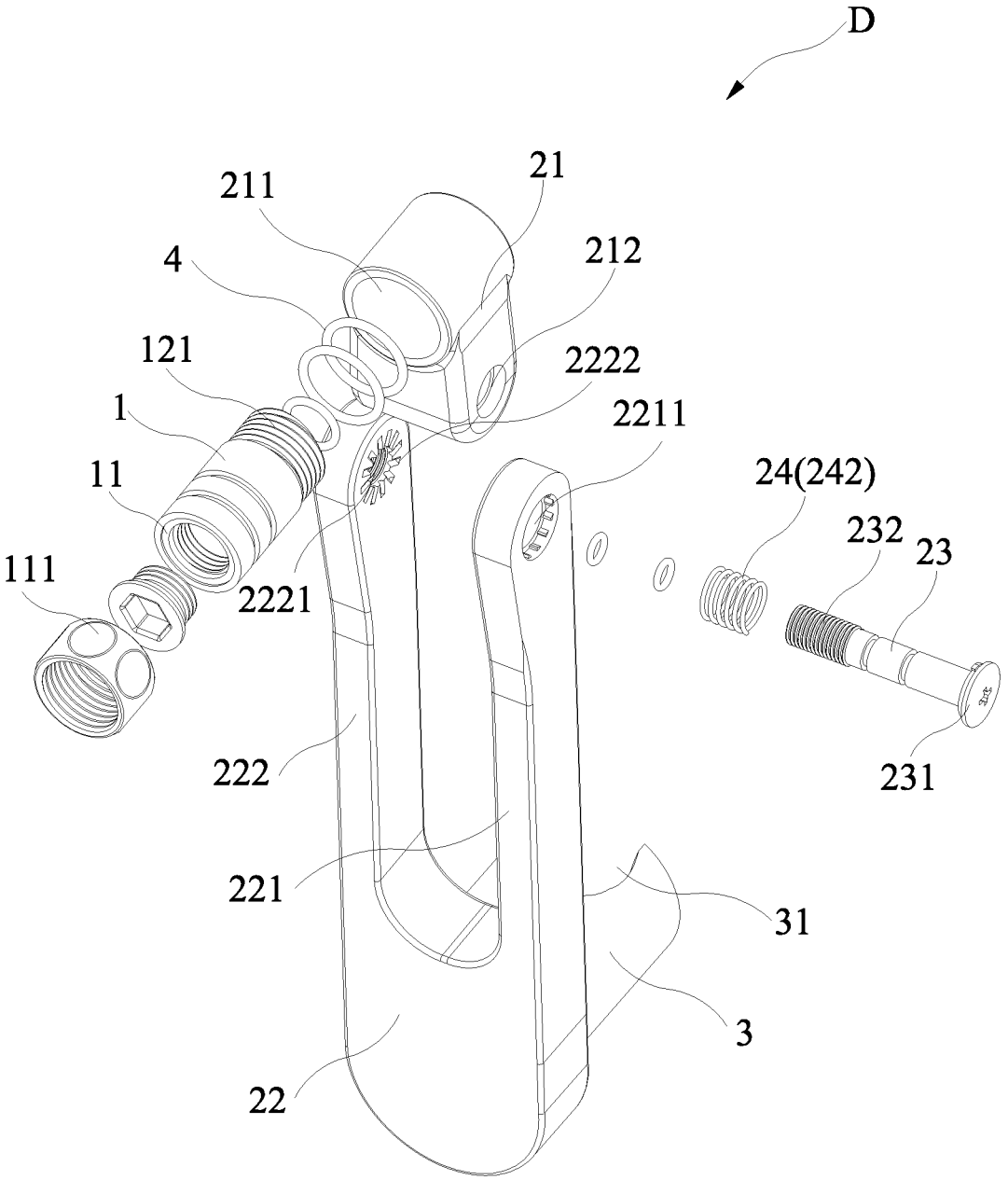
FIG. 6 is an exploded view of the shower head holder according to the second embodiment of the present invention.
Figure 7:
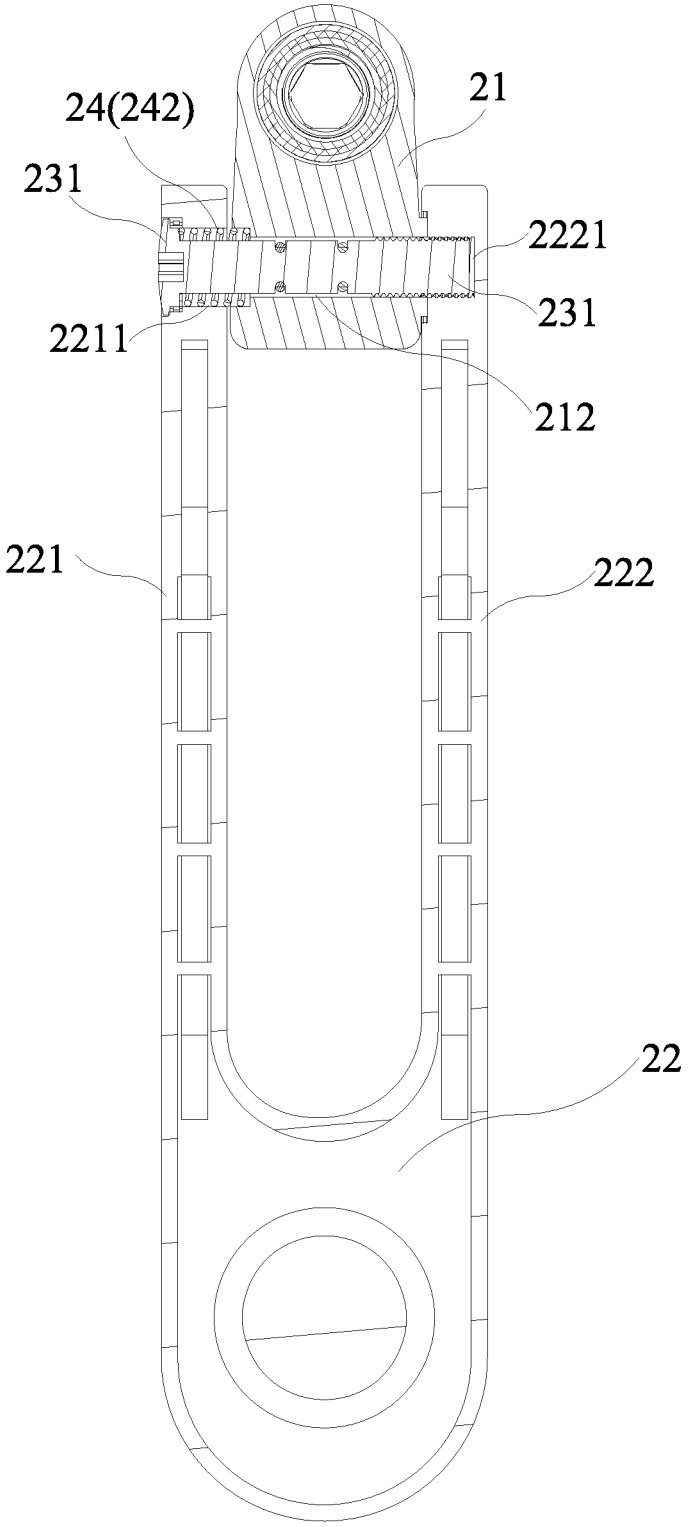
FIG. 7 is a cross-sectional view of the shower head holder according to the second embodiment of the present invention.
Figure 8:
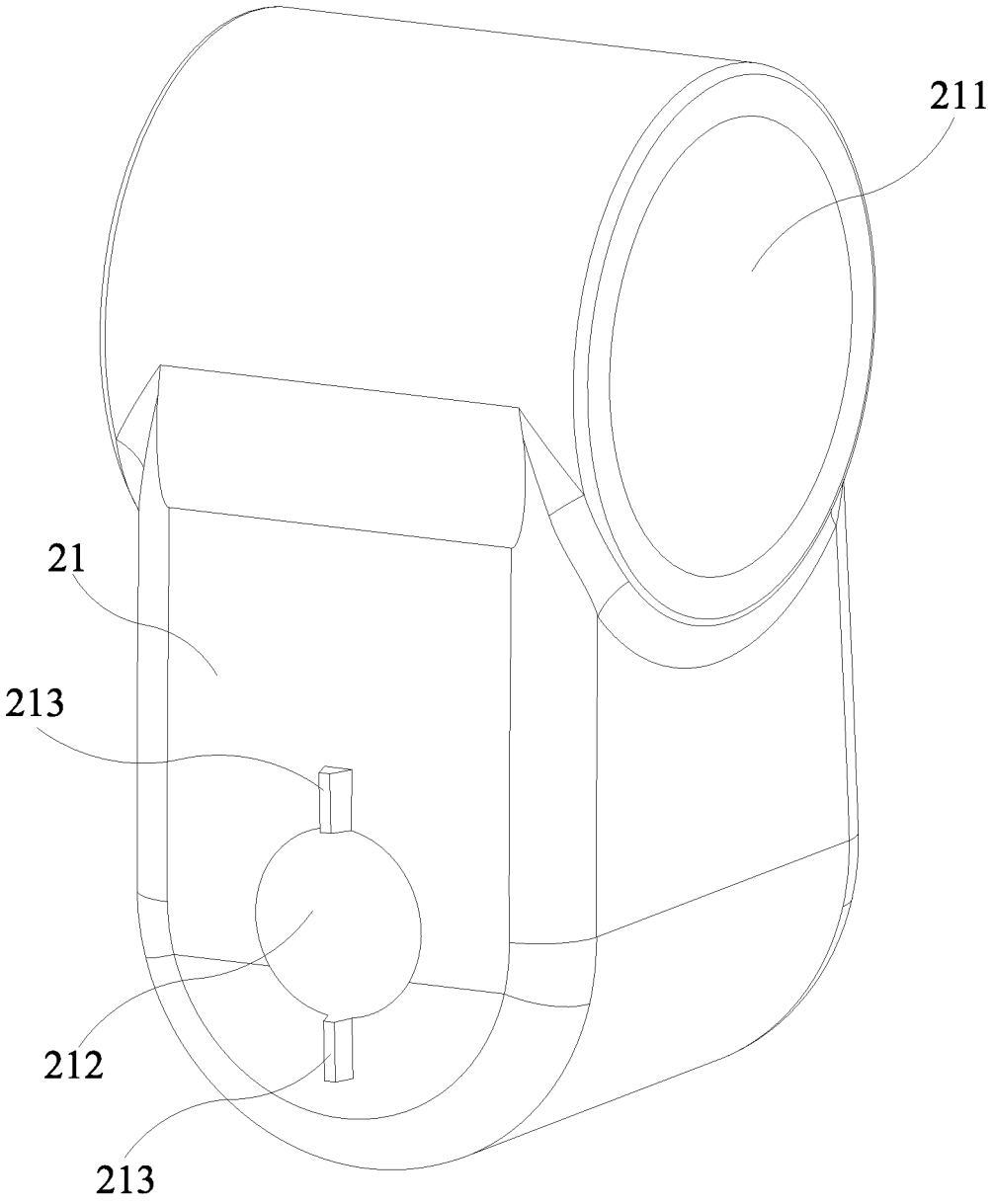
FIG. 8 is a schematic view of the retaining seat according to the second and third embodiments of the present invention.
Figure 9:
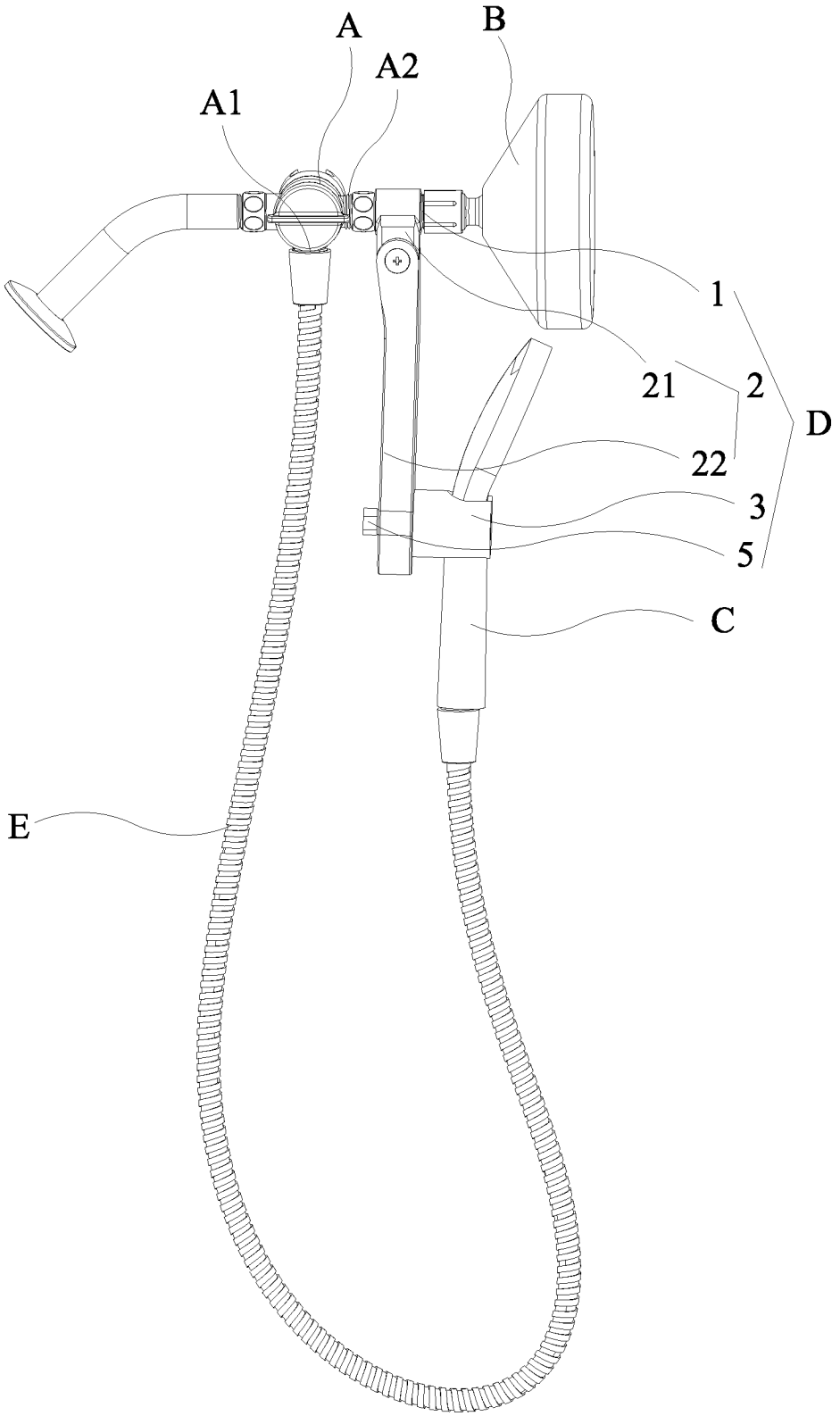
FIG. 9 is a schematic view of the easy-to-use combined shower set according to a third embodiment of the present invention.
Figure 10:
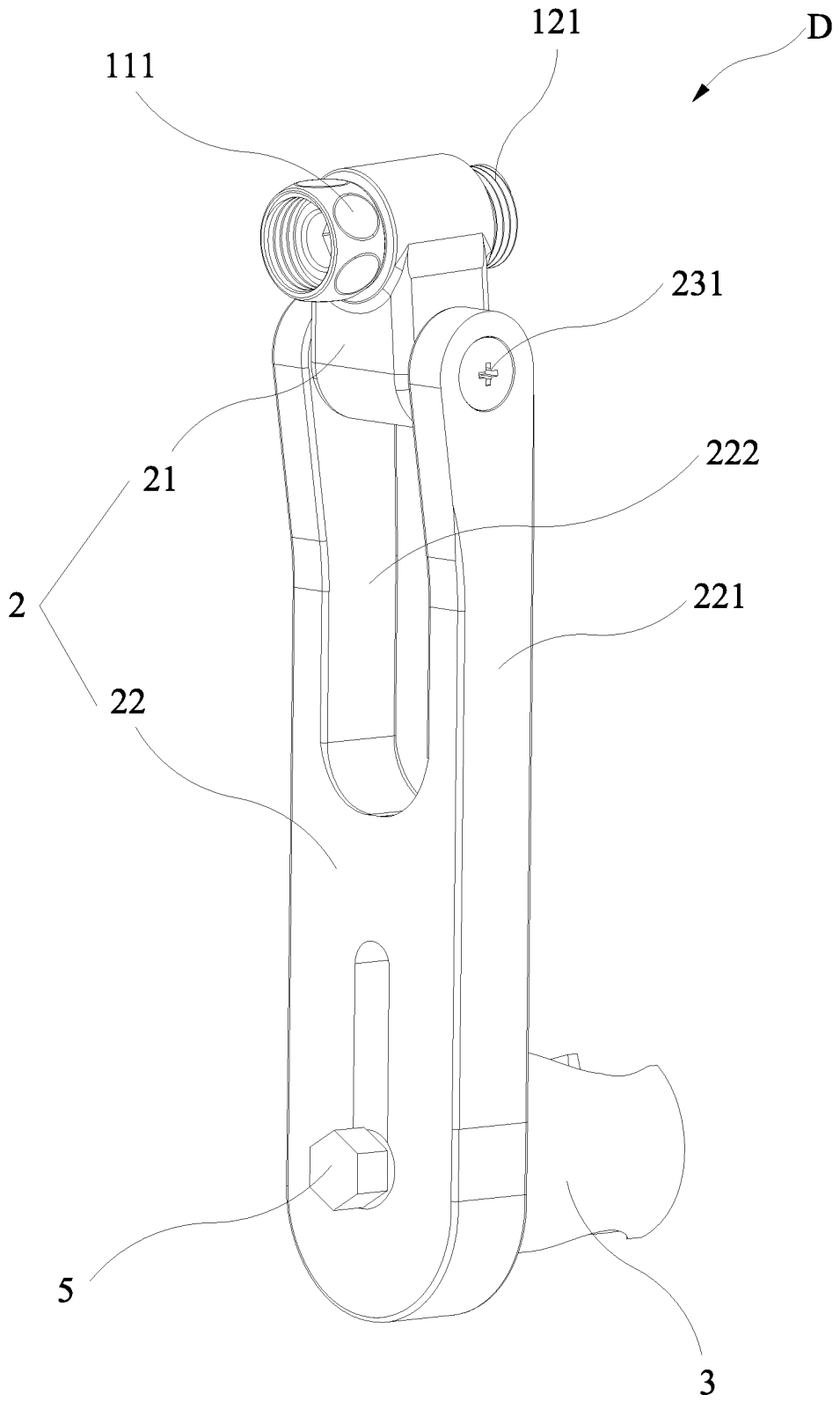
FIG. 10 is a schematic view of the shower head holder according to the third embodiment of the present invention.
Figure 11:
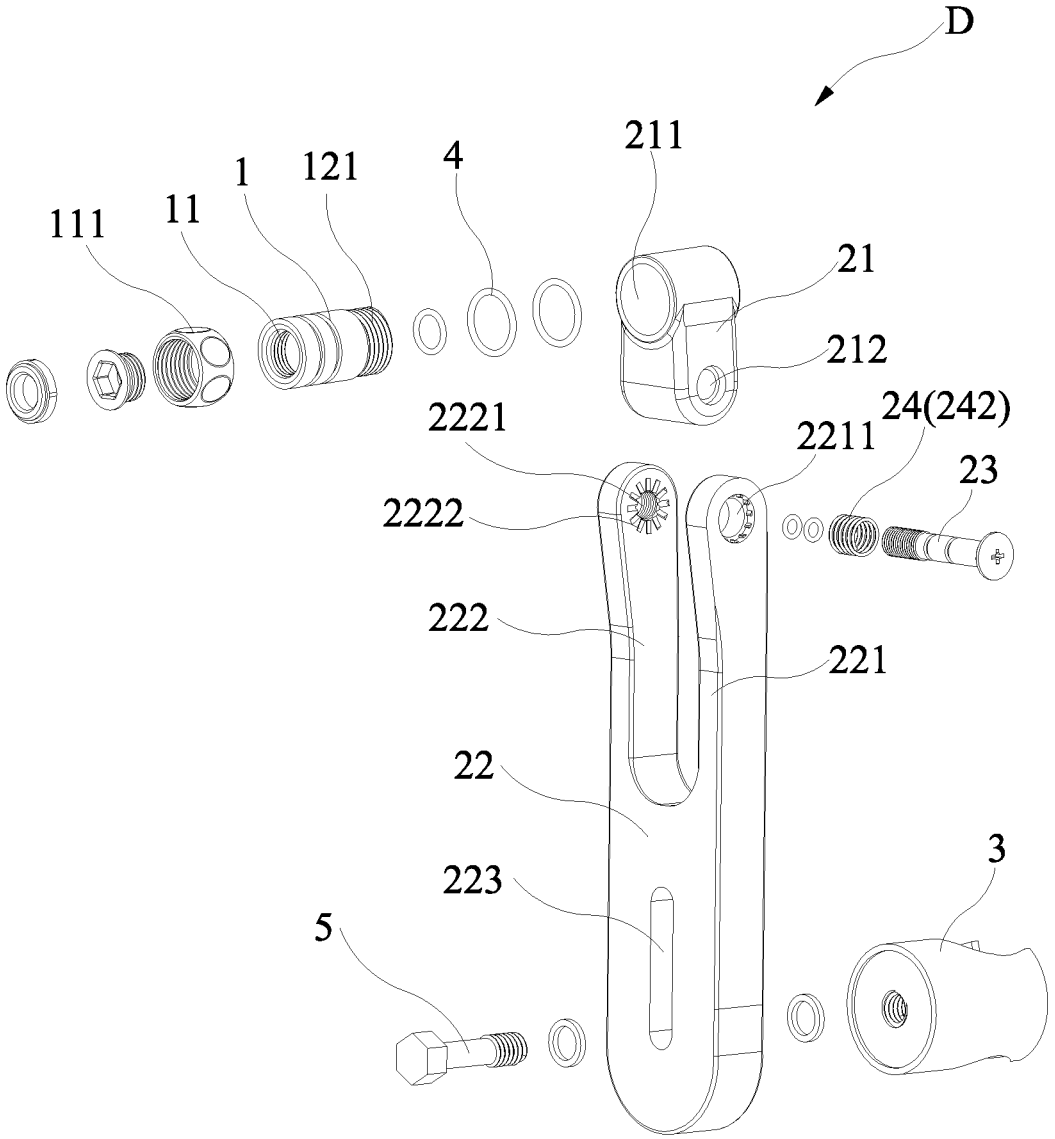
FIG. 11 is an exploded view of the shower head holder according to the third embodiment of the present invention.
Figure 12:
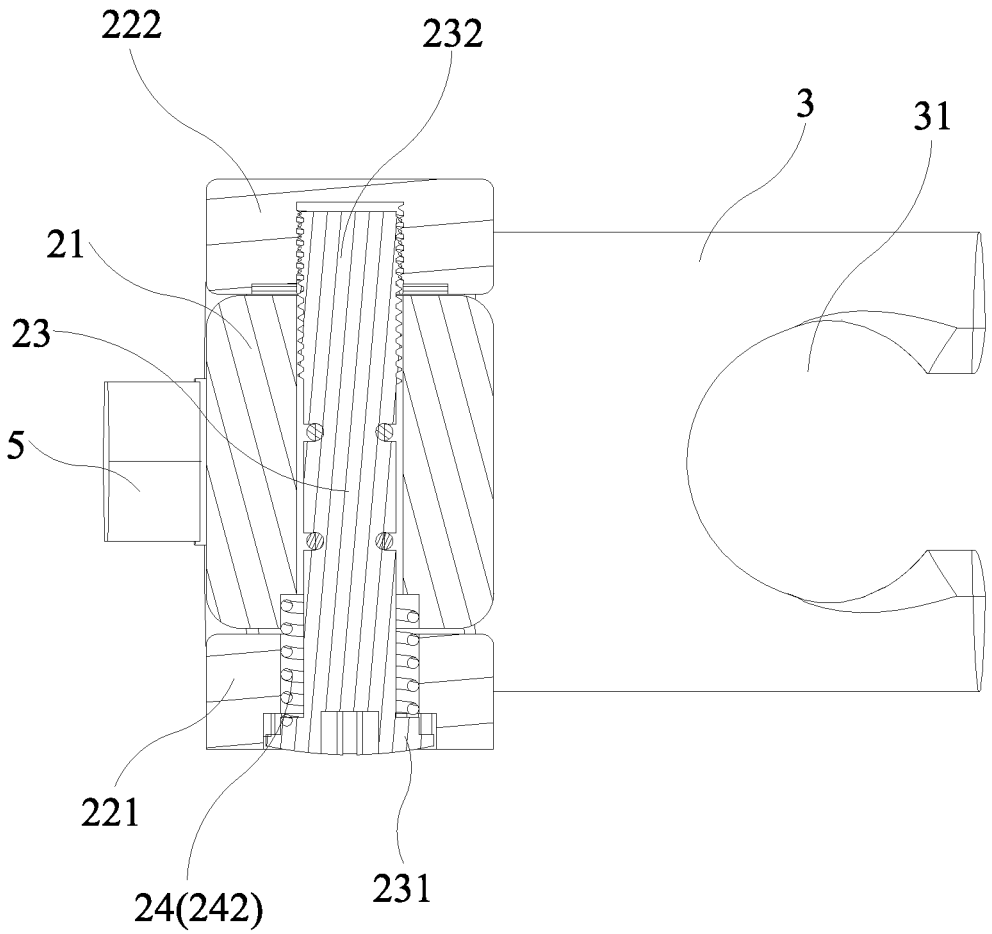
FIG. 12 is a first cross-sectional view of the shower head holder according to the third embodiment of the present invention.
Figure 13:
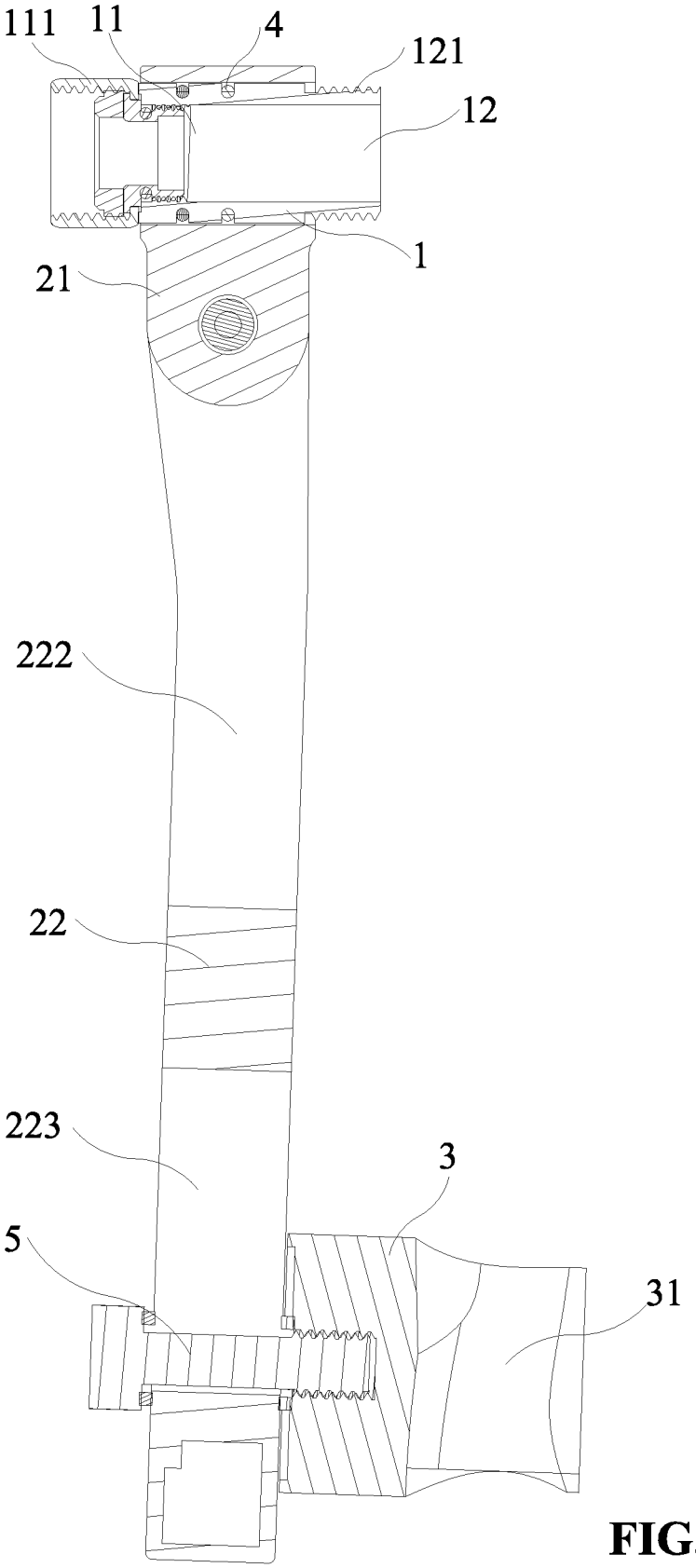
FIG. 13 is a second cross-sectional view of the shower head holder according to the third embodiment of the present invention.

In the first embodiment, the second embodiment and the third embodiment of the present invention, the shower head seat 3 has an accommodating groove 31 for accommodating the hand-held shower head C. Referring to FIG. 2, FIG. 3 and FIG. 6, in the first and second embodiments of the present invention, the shower head seat 3 is fixedly installed on the movable frame 22 of the holder body 2. The shower head seat 3 may be integrally formed with the movable frame 22 of the holder body 2. Alternatively, the shower head seat 3 may be connected to the movable frame 22 of the holder body 2 after being formed separately. Referring to FIG. 10, FIG. 11 and FIG. 13, in the third embodiment of the present invention, the shower head seat 3 is installed on the holder body 2 and is adjustable in height, so that the user can adjust the height of the shower head seat 3 to be installed according to his/her needs, and the user experience is good. Specifically, the movable frame 22 of the holder body 2 has a slot 223 extending in a direction along its length. The shower head seat 3 is locked to the movable frame 22 of the holder body 22 by a bolt 5 passing through the slot 223. In this way, the height of the shower head seat 3 to be installed on the holder body 2 can be adjusted by adjusting the locking position of the bolt 5.

In summary, the shower head holder D of the present invention includes the connector 1 and the holder body 2. The holder body 2 is equipped with the shower head seat 3 for holding the hand-held shower head C. The shower head seat 3 is lower than the connector 1 configured to connect the three-way switching valve A and the overhead shower head B. In this way, when the shower head holder D of the present invention is connected to the three-way switching valve A and the overhead shower head B, the shower head seat 3 is low in height, so that it is convenient for a short user to place the hand-held shower head C on the shower head seat 3 or remove the hand-held shower head C from the shower head seat 3. In addition, the shower head holder D of the present invention has the connector 1 for connecting the three-way switching valve A and the overhead shower head B. In this way, the shower head holder D of the present invention can be adapted to the existing combined shower set, so that the user can purchase the shower head holder D of the present invention separately and modify the existing combined shower set at home into the easy-to-use combined shower set of the present invention.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A shower head holder, comprising a connector and a holder body connected to the connector;

the connector having a water inlet and a water outlet communicating with the water inlet;

the holder body being equipped with a shower head seat for holding a hand-held shower head, the shower head seat being lower than the connector;

the holder body includes a retaining seat connected to the connector and a movable frame hinged to the retaining seat, and the movable frame is equipped with the shower head seat;

an elastic member is disposed at a hinge joint of the retaining seat and the movable frame, and two sides of the elastic member lean against the retaining seat and the movable frame, respectively;

the movable frame has a plurality of positioning grooves arranged radially, and the retaining seat has positioning ribs that are movably fitted with the positioning grooves.

2. The shower head holder as claimed in claim 1, wherein the retaining seat has a receiving hole for receiving the connector, and an elastic ring is disposed between an inner wall of the receiving hole and the connector.

3. The shower head holder as claimed in claim 1, wherein the elastic member is one of an elastic gasket and a spring.

4. The shower head holder as claimed in claim 1, wherein the retaining seat and the movable frame are hinged through a hinge shaft, and the hinge shaft passes through the elastic member.

5. The shower head holder as claimed in claim 4, wherein the movable frame includes a first connecting rod and an opposing second connecting rod, the first connecting rod has a through hole, the second connecting rod has a screw hole; the retaining seat is connected between the first connecting rod and the second connecting rod, the retaining seat has a rotation hole; two ends of the hinge shaft are defined as an engaging end and a threaded end respectively, the engaging end of the hinge shaft is in contact with the first connecting rod, and the threaded end of the hinge shaft passes through the through hole of the first connecting rod and the rotation hole of the retaining seat in sequence and is screwed to the screw hole of the second connecting rod.

6. The shower head holder as claimed in claim 1, wherein the shower head seat is installed on the holder body and is adjustable in height.

7. The shower head holder as claimed in claim 6, wherein the holder body has a slot extending in a direction along its length, and the shower head seat is locked to the holder body by a bolt passing through the slot.

8. The shower head holder as claimed in claim 1, wherein the water inlet of the connector is equipped with a rotatable nut, and an outer wall of the water outlet of the connector is formed with an external thread.

9. An easy-to-use combined shower set, comprising a three-way switching valve, an overhead shower head, a hand-held shower head, and the shower head holder as claimed in claim 1; the three-way switching valve having a first outlet and a second outlet; the hand-held shower head being connected to the first outlet of the three-way switching valve via a hose, the overhead shower head being connected to the second outlet of the three-way switching valve via the shower head holder, the water inlet of the connector of the shower head holder being connected to the second outlet of the three-way switching valve, the water outlet of the connector of the shower head holder being connected to the overhead shower head.

* * * * *